United States Patent [19]

Gyimothy et al.

[11] 4,024,984

[45] May 24, 1977

[54] DISPENSER WITH AT LEAST ONE EJECTION OPENING FOR INDIVIDUAL EMISSION OF PARTICLES OF A UNIFORM SHAPE AND SIZE, PREDOSED AS BULK MATERIAL

[76] Inventors: Gábor Gyimothy, 84, Hirzenbachstrasse, 8051 Zurich; Josef Tresch, 10, Am Pfisterholzli, 8606 Greifensee, both of Switzerland

[22] Filed: June 26, 1975

[21] Appl. No.: 590,734

[30] Foreign Application Priority Data

June 28, 1974 Switzerland ..... 8970/74

[52] U.S. Cl. ..... 221/203; 221/262; 221/265

[51] Int. Cl.[2] ..... B65D 83/04

[58] Field of Search ..... 221/265, 277, 273, 276, 221/203, 262; 222/370

[56] References Cited

UNITED STATES PATENTS

| | | | |
|---|---|---|---|
| 2,134,180 | 10/1938 | Felber | 221/262 X |
| 2,227,167 | 12/1940 | Warren | 221/265 |
| 3,327,897 | 6/1967 | Weitzman | 221/265 |

FOREIGN PATENTS OR APPLICATIONS

| | | | |
|---|---|---|---|
| 1,297,136 | 5/1962 | France | 221/265 |
| 311,976 | 6/1969 | Sweden | 221/265 |

*Primary Examiner*—Robert B. Reeves
*Assistant Examiner*—Charles A. Marmor
*Attorney, Agent, or Firm*—Sughrue, Rothwell, Mion, Zinn & Macpeak

[57] ABSTRACT

The invention relates to a dispenser with at least one ejection opening for the individual dispensing of particles of uniform shape and size, predosed as bulk material, consisting of a cupshaped first rotational body and of a second rotational body disposed coaxially therein, whereby the dispensing of the particles is accomplished by operation of the dispenser.

4 Claims, 15 Drawing Figures

DISPENSER WITH AT LEAST ONE EJECTION OPENING FOR INDIVIDUAL EMISSION OF PARTICLES OF A UNIFORM SHAPE AND SIZE, PREDOSED AS BULK MATERIAL

DESCRIPTION OF THE PRIOR ART

In the pharmaceutical industry as well as in the foodstuff industry and elsewhere, the material put on the market is often organized in the sense of a portioning by particles of uniform quantity, which as a result of their finishing effectively have a uniform shape and dimensions. In this way, the portioning in the case of the consumer is limited to the counting of the particles. Examples are pellets and tablets of all kinds, cube sugar, bouillon cubes, ect.

Particularly in the case of material which had been particulated small, it is customary to process the latter as a bulk material when filling the commercial packages and not to count the particles, but to weight them counter balance. In such packages the particles, insofar as they are not ball shaped pellets, lie in an unorganized manner.

This circumstance makes difficult the attachment of a simple removal device which would dispense with sufficient reliability one particle after the other from the container. Therefore it is the rule that the container be provided with an opening which is large enough in relation to the substance particle and that for the purpose of removal of a particle or particles the container is tilted toward the palm of the hand or some other support, the desired particle is removed, and whatever came out in excess of the quantity desired is returned by hand again into the container.

Because of a lack of anything better, this is put up with although this process is not perfect hygienically. Particularly it is unhygienic, if in the case of the substance it is not a matter of a personally prescribed medication, but when we are dealing with some article which is used by several persons, such as for example an artifical sweetener. Here, the need for a dispenser system is particularly apparent.

That in the case of an unorganized supply of particles, the decrease of the removal opening up to about the size of the dimensions of the particle will not solve the problem is shown by the accidental results of the flat pocket packagings made of metal with a sliding lid. It can occur that a single tablet drops out. But a number of tablets can get jammed up also behind or in the relatively small opening. When loosened up by shaking, in that case often a multiplicity of particles emerges from the opening. Whatever of this is not used must be put back.

Therefore, in the case of restaurants, the bypass by way of packaging of a small number of particles in closed paper bags is taken, whereby the contents roughly agree to the maximum individual requirement. This solution is expensive in the packaging and brings about losses in the case of the sweetener.

Therefore, a suitable package which would count out the articles, especially for collective use, is lacking.

SUMMARY OF THE INVENTION

It is the task of the invention to create a dispenser in the case of which an organizing process is applied between the particle supply stored in a container as a bulk material and the ejection opening, which process under the effect of gravity and of the operating forces to be applied in case of operation of the dispenser will guarantee the individual dispensing of the particle.

According to the invention this will be achieved through the fact that means are provided for the gradual twisting of the two rotational bodies in relation to one another and in that further means are available which accomplish an organizing process between the supply of bulk material and the ejection opening, in the case of which process with a continuous operation of the dispenser, the mass of the unorganized particles is moved in the direction of the ejection opening and with an increasing approach to the ejection opening, is organized in its spatial position and thus is prepared for a simple mechanical ejection, and which moving and organizing process works with the gravity and the forces which are applied to operate the dispenser.

BRIEF DESCRIPTION OF THE DRAWINGS

In the following paragraphs embodiments of the invention presented by way of examples will be explained in more detail on the basis of the drawings.

DETAILED DESCRIPTION OF THE PREFERRED EMBODIMENTS

Figure 1:
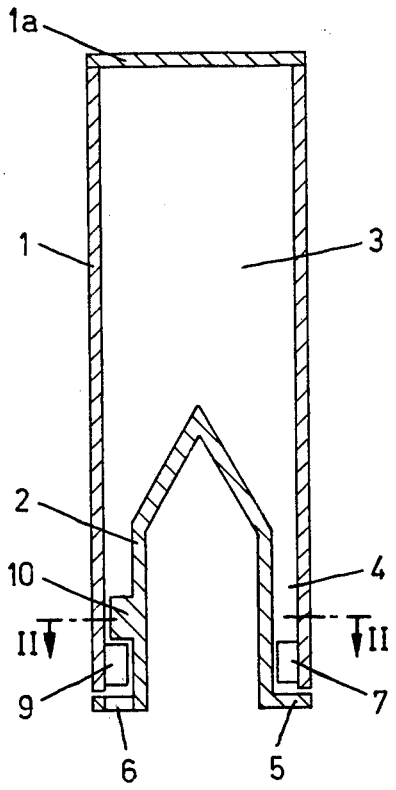
FIG. 1 shows the organizing and functioning principles of a dispenser shown schematically in longitudinal section.
Figure 3:
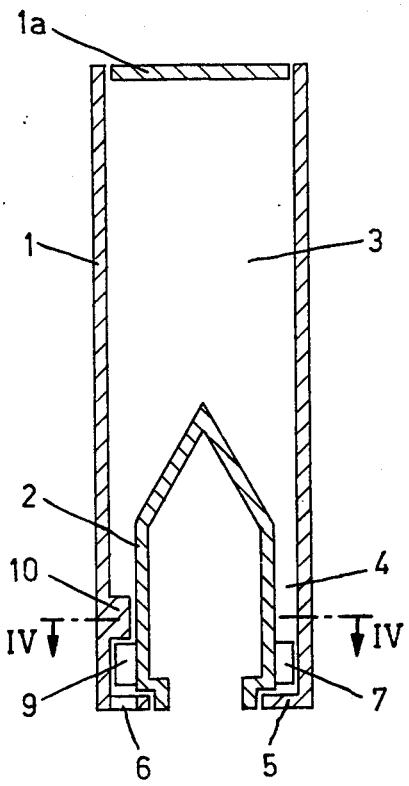
FIG. 3 shows the organizing and functioning principles of a further dispenser shown schematically in longitudinal section.
Figure 2:
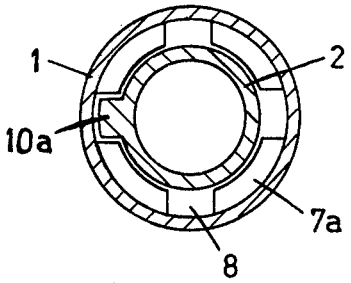
FIG. 2 shows a cross-section following the line II—II of FIG. 1.
Figure 4:
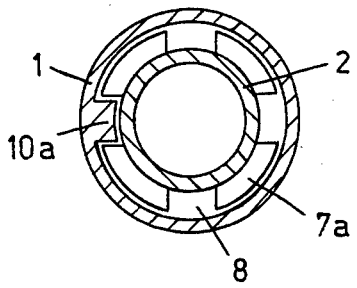
FIG. 4 shows a cross-section following the line IV-13 IV of FIG. 3.

In a cupshaped rotational body 1, pointing downwards with its opening and briefly called cup, a smaller rotational body 2, briefly called the insert, projects from below in a coaxial position in relation to the first rotational body into the hollow space of the second rotational body, so that the two rotational bodies 1, 2 together enclose an axially symmetrical hollow space 3, the cross section of which standing perpendicularly in relation to the rotational axis and viewed moving from top to bottom passes over from the shape of a complete circle to an annular shape, whereby the inner circle and the outer circle of the ringshaped area continuously approach each other until the annular space becomes an annular gap 4, which accommodates the particles of substance in the width of the gap only in their smallest dimension. The annular gap 4 is closed below in a plane standing perpendicularly to the rotational axis as a result of a cover 5 except for at least one ejection opening 6. The two rotational bodies, cut 1 and insert 2, are coaxially twistable in relation to one another by rotational steps. The cover 5 for the annular gap can either be firmly and untwistably connected with the insert 2 or with the cup 1. Therefore the ejection opening 6 correspondingly executes a relative rotation in relation to the cup 1 or the insert 2. Immediately above the cover 5 of the annular gap 4, a first cam ring 7 is disposed, which is rooted in that of the rotational bodies 1, 2 which rotates upon operation of the dispenser in relation to the gap cover 5 with ejection opening 6. The cams 7*a* of the first cam ring 7 project into the annular gap 4 and partially close the latter. These cams 7*a* therefore are rooted in the cup 1, whenever the cover 5 is connected firmly and untwistably with the insert 2 and inversely they are rooted in the insert 2 whenever the cover is firmly and untwistably connected with the cup 1. The cam 7*a* distributed evenly over the periphery of the annular gap 4 leave gaps 8 of such a length of an arc open between consecutive cams that one substance particle with its largest dimension will find sufficient place in there without jamming. Between these cams 7*a* therefore, there are pockets 9 limited by the cup 1, the insert 2 and the cover 5 for the gap into which particles coming from the supply of bulk goods lying above can drop. In order that sufficient particles would drop regularly into these pockets 9, an organizing process must be accomplished between the unorganized bulk goods supply lying above and the zone of the annular gap lying directly above these pockets 9, in the case of which process all particles enter the annular gap 4 on edge (upright) and organize themselves into annular layers. This process is accomplished as a result of the following characteristics:

a. The upright position is forced as a result of the width of the annular gap;

b. The relative rotation of the rotational surfaces of the rotational bodies, 1, 2 enclosing the annular gap 4 brings about with every rotational step a loosening between the individual particles as a result of friction between them and said particles and thus furthers their dropping down into the annular gap 4;

c. Immediately above the cam ring 7 forming the pockets 9, at least one driver cam 10*a* is disposed, which is rooted in that one of the rotational bodies 1, 2 which is firmly and untwistably connected with the gap cover 5, so that upon operation of the dispenser by a gradual twisting of cup 1 and insert 2 in relation to one another, said driver cam 10*a* carries out a relative turn in relation to the cam 7*a* forming the pockets.

The driver cams 10*a* accomplish multiple things:

1. The driver cams 10*a* impart their movement to the particles which knock against them.
2. Annular layers of particles, which have gaps, are pushed together by the driven particles, so that they form closed annular layers.
3. Layers of particles put into motion by the driver cams 10*a* impart their movement to the annular layer of particles resting on them, because of friction with a certain slip, and this movement again is imparted to the next layer and so forth. As a result of this sllip, there develops a relative movement between the individual layers, which has an unlocking and loosening effect on the particle sequences.
4. The driver cams 10*a* push particles lying in their plane in front of themselves, so that said particles drop into the pockets 9 which, owing to the relative movement between pockets 9 and driver cams 10*a*, move toward them at every step of rotation.
5. In the case of a suitable arrangement of the driver cams 10*a*, the latter fulfill an important additional function. They lie in the annular gap 4 in such a way and they are dimensioned in the length of their arc in such a way, that their rotationally axis-parallel projections onto the gap cover surface, cover up the ejection openings 6 in the gap cover 5 at least for their greatest part. This position of the driver cams 10*a* above the ejection opening 6 is firm, since the driver cams 10*a* are rooted in the same rotational body 1, 2 which is also firmly and untwistably connected with the gap cover 5. If therefore in the relative rotation one pocket 9 in the first cam ring 7 meets an ejection opening 6 and as a result of that ejects the particle contained in it, then one driver cam 10*a* will stand in front of the upper entry of the pocket 9 and thereby prevent any further particle from being able to drop from the dispenser from the upper layer right through the open pocket 9. Therefore the dispenser in the case of one rotational step can eject only the contents of the open pocket 9.
6. The cams 7*a* of the pocket forming first cam ring 7 slope away slantingly on their side pointed toward the supply of bulk material in such a way (FIG. 7, 14), that upon their rotational movement, the lower ends of the cams (contrary to the teeth of milling cutters) are leading. The cams 7*a* at their highest position and viewed in an axial direction, are somewhat higher than the greatest dimension of the particle and at their lowest position are lower than the particle which lies in the pocket 9. Thus one will avoid on the one hand that the rotating cam 7*a* with its front edge in the rotational direction will knock hard against particles of the upper annular layer. The highest edge of the cam 7*a* is so to speak "dragged behind" and particles of the upper layer run up (pile up) gradually to this level of the cam 7*a*. This piling up (running up) to the highest level of the cam and this dropping back again to the level of the particle lying in one pocket 9 results in a periodic lifting movement which is imparted to the particles lying further above and which, as a result of that, exerts an additional unblocking effect on the mass of particles and as a result of that furthers the organizing process.

On the basis of the organizing and functioning principles described, various embodiments are possible, for example embodiments in the case of which the relative rotation between cup 1 and insert 2 taking place step by rotational step through twisting of constructional units seizable from the outside in relation to one another from place of stop, whereby one place of stop is always provided whenever a pocket 9 of the first ring of cam 7 is open on the bottom and can eject its content.

The organizing and functioning principle of the dispenser remains unchanged even if the step by step relative rotation between the cup 1 and the insert 2 is accomplished directly by a mechanical conversion of movement or if by electro-mechanical means, in that the operation consists in some other but rotational movement.

Figure 7:
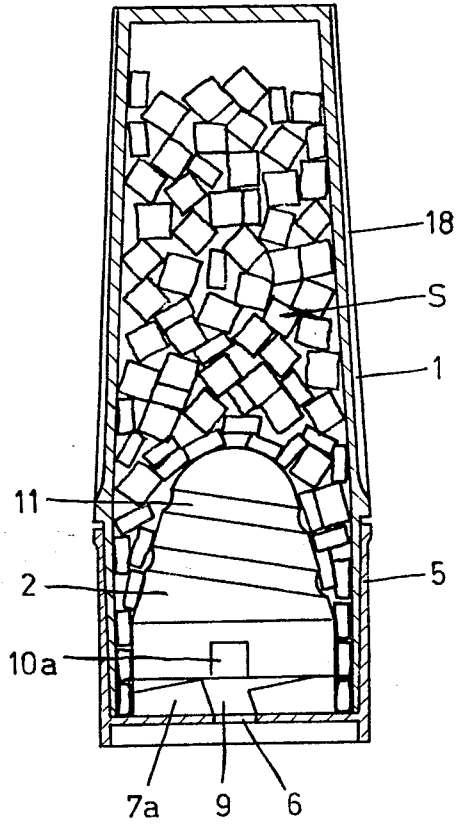
FIG. 7 shows a schematically a filled dispenser and the arrangement of the cams on the two rotational bodies.
Figure 6:
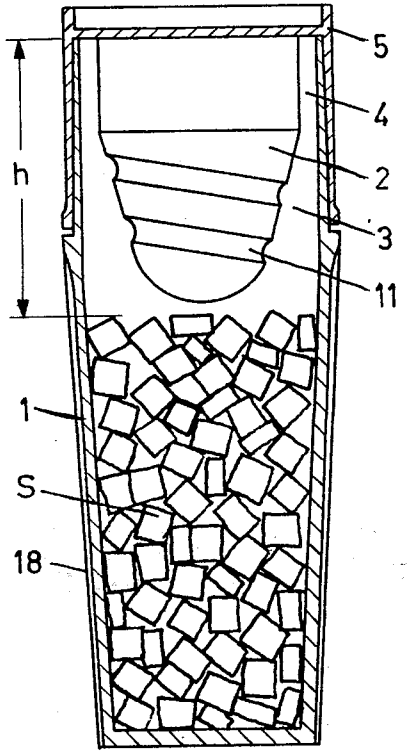
FIG. 6 shows the cupshaped first rotational body according to FIG. 5 with cover and with inserted, partially coneshaped second rotational body.
Figure 5:
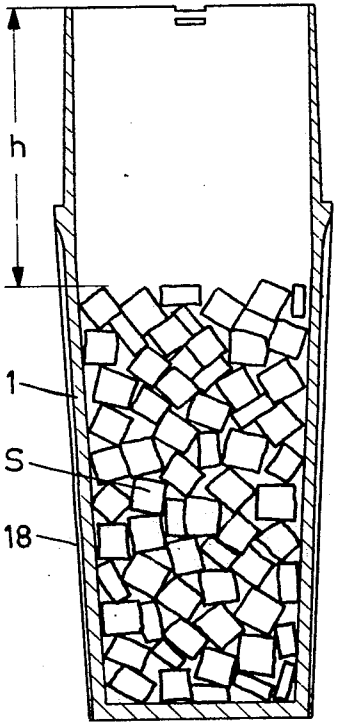
FIG. 5 shows a longitudinal section through the filled, schematically presented, cupshaped rotational body.

The filling up process and further characteristics of the dispenser will be explained on the basis of the FIGS. 5 to 7.

The cup 1 which is high in relation to its diameter is filled leaving open a certain height *h* with particulated bulk material S, for example sweetener. The cover 5 is placed onto said cup, 1 in the inside of which the insert 2 is rooted, which tapers in the direction away from the cover 5 initially only slightly and then more pronouncedly. The height of the insert 2 corresponds approximately to the marginal height *h* of the cup 1, so that upon putting on of the cover 5, the insert 2 dips into the cup 1 until it contacts approximately the filled in particles.

In its position for use, the cover 5 is on the bottom and the supply of tablets is on top. The cover 5 serves as the foot or the base. In this position a part of the particles, for example tablets, drops into the part of the space 3 with an annular shaped cross section between the inside wall of the cup and the insert 2. The annular shaped cross section of the space tapers downwards to an annular gap 4, the inside diameter of which is dimensioned is such a way that the tablets will just barely find their place with their smallest dimension in the width of the cup. The tablets therefore must position themselves on edge, if they are to come downwards to the cover 5. The dispensing mechanism that is to be described later on, is operated by turning the cup 1 in relation to the cover 5 coaxially by an angle. The wall of the cup and the insert 2 connected with the cover 5 therefore turn against each other. The friction between the tablets and the walls of the cup 1 and insert 2 turning against each other helps to break up jammings and wedgings and thus to move the tablets into the required on-edge position.

The directing effect of this rotational movement is considerably reinforced through the driver cam 10*a* projecting into the annular gap 4, which cams are attached to the insert 2 and which force upon the tablets which abut against them the same movement which is executed by the insert 2 in relation to the cup 1. These tablets impart the movement to the remaining tablets in the same annular layer after possibly existing gaps have been pushed together and the annular layer of the tablets imparts this movement to the next higher annular layer of tablets in consequence of friction and with a certain slip etc.

As a result of this slip higher annular layers again show a clear relative movement in relation to the insert 2, which is utilized in order to increase the organizing effect of the rotational movement. For this purpose, the insert 2 on its surface has a groovelike, helically shaped erosion 11, the pitch and rotational direction of which are such, that tablets which have come into engagement with said erosion 11 are lifted and as a result of that are freed from jammings with other tablets. In this way, the tablets which have been stored in an unorganized manner on top are organized continuously downwards where they form organized and closed annular layers of tablets standing on edge.

Thus, the prerequisites for a mechanical, individual removal for the ejection of individual tablets have been created.

Before the tablets are ejected individually, the closed annular layers of tablets are converted into a loose regular sequence of tablets, in the case of which the interstices between successive tablets are of such size that an ejection apparatus which is tolerant with regard to dimensions and therefore inexpensive, will be sufficient and above all that no particular demands are made of the rotational movement and accuracy as to size of the tablets.

Figure 9:
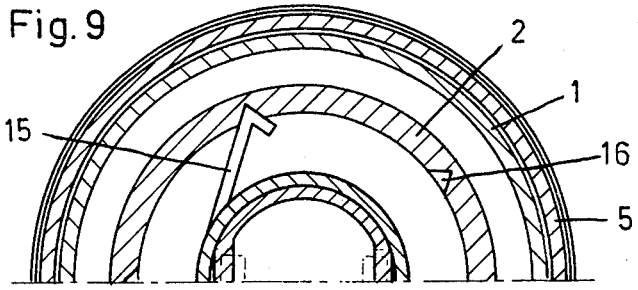
FIG. 9 shows a cross-section following the line IX—IX of the dispenser of FIG. 8.
Figure 8:
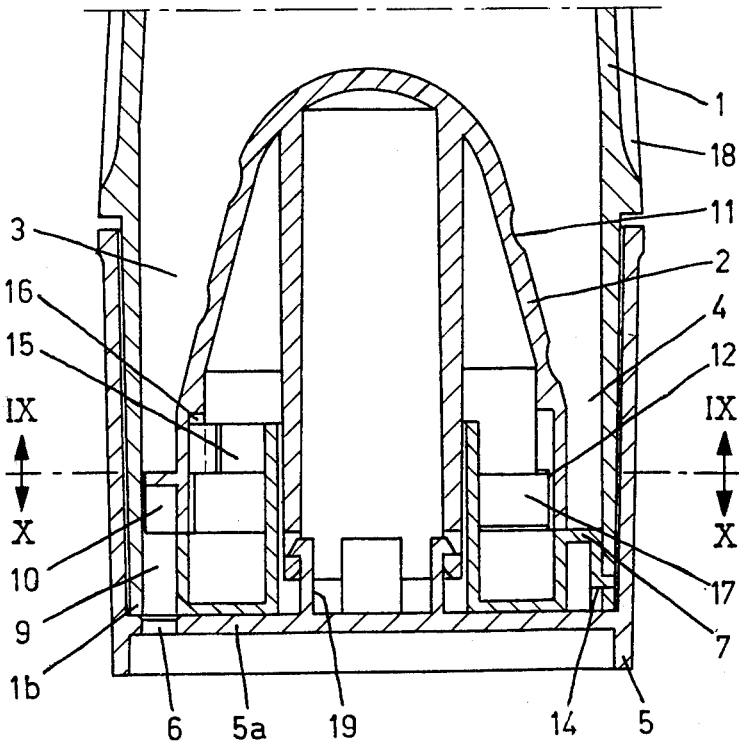
FIG. 8 shows a longitudinal section through the lower part of a third embodiment of a dispenser.
Figure 10:
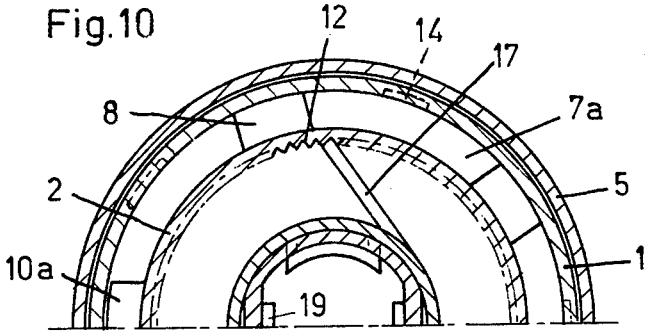
FIG. 10 shows a cross-section following the line X—X of the dispenser of FIG. 8.
Figure 14:
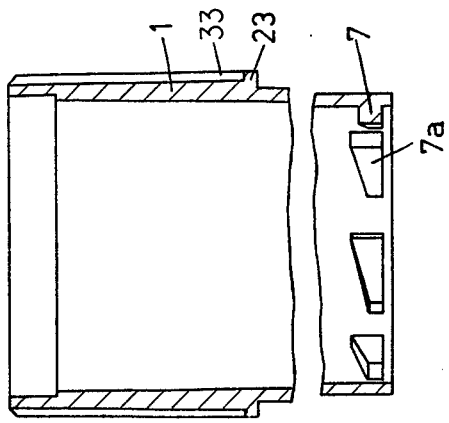
FIG. 14 shows a longitudinal section through the cupshaped rotational body of the dispenser according to FIG. 11.
Figure 15:
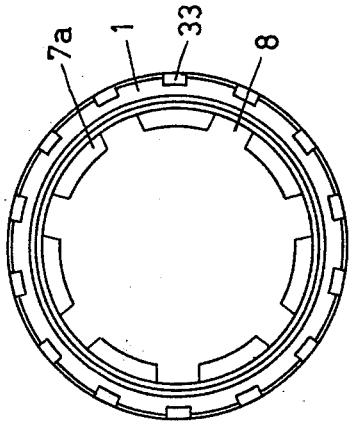
FIG. 15 shows the vertical first angle projection of the rotational body according to FIG. 14.
Figure 12:
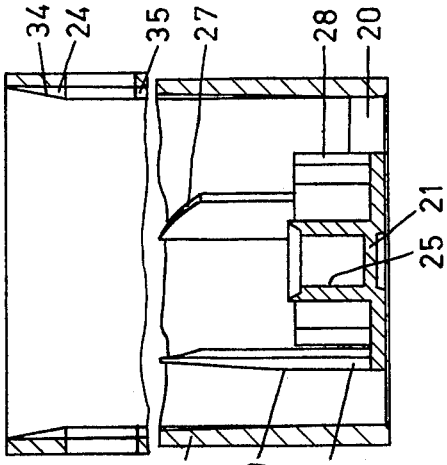
FIG. 12 is a longitudinal section through the casing of the dispenser according to FIG. 11.
Figure 13:
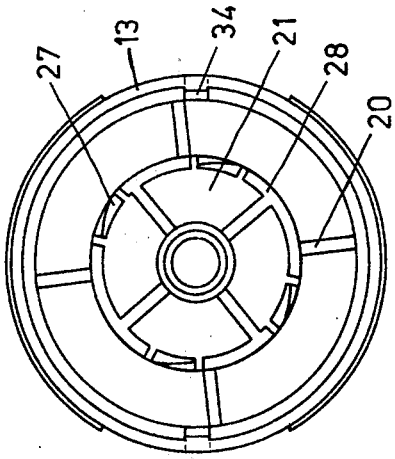
FIG. 13 shows the vertical first angle projection of the casing of the FIG. 12.
Figure 11:
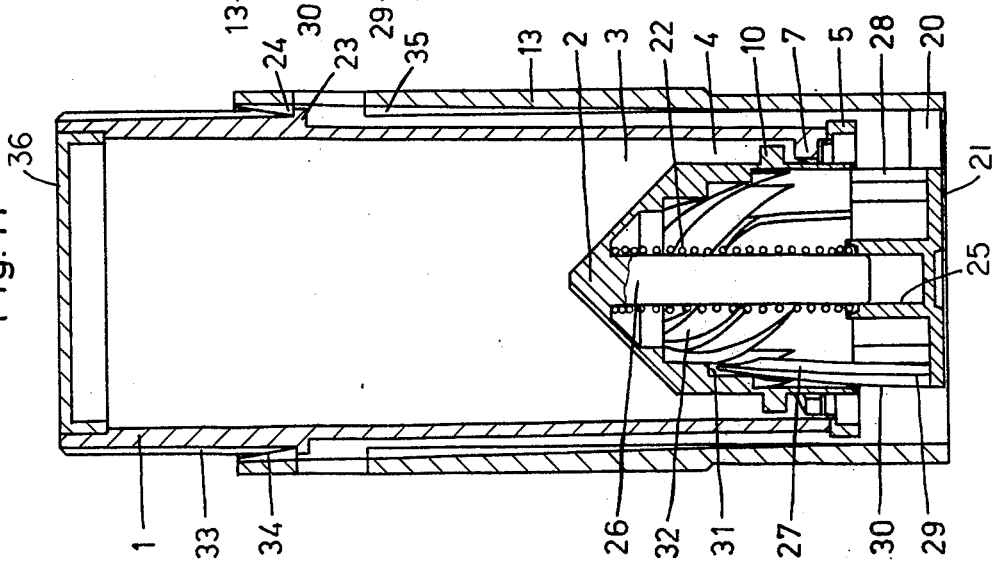
FIG. 11 is a longitudinal section through a fourth embodiment of a dispenser.

In the FIGS. 8 to 10 a third embodiment of a dispenser is shown.

Below the driver cams 10*a*, which project from the insert 2 into the annular gap 4, the ring of cams 7 forming pockets has been disposed. Individual tablets are separated with the aid of said ring distributed over the periphery of the annular gap 4, from the lowest closed annular layer and are moved into the next lower layer.

This first cam ring 7 rotates upon operation of the dispenser coaxially in relation to the insert 2, is mounted in the body of the insert 2 coaxially rotatable and is held (fixed) in an axial direction and upon placement of the insert 2 with cover 5 onto the cup 1, it is firmly axially and untwistably anchored with the latter by way of connecting cams 14 and therefore turns with the cup 1. The parts of the first cam ring 7 projecting into the annular gap form a ring of blade-shaped cams 7*a*, the greatest axial height of which amounts to slightly more than the largest dimension of the tablet.

The arc length of the gap of the blade-shaped cam 7*a* is dimensioned in such a way that one tablet will find sufficient space in each interstice 8 without a possibility of jamming. As shown, the backs of the cams point upward, the hollow parts downward. The surfaces of the backs of the cams run in the form of a tooth of a milling cutter from below to above, however inversely to the tooth of a milling cutter, that is to say the blade-shaped cam 7*a* viewed in its rotational direction is lower in front than it is in back (FIG. 7, 14). Directly below, fitting against the cam ring 7, there is the cover 5. The latter has a disc 5*a* rotating in relation to the cam ring 7 upon operation of the dispenser and closing the interstices 8 between the cams on the bottom, as a result of which disc the interstices 8 between the blades become pockets 9.

In the present example, the cover 5 is put in an inverted position over the free edge 1*b* of the cup 1 and is firmly axially and untwistably connected with the body of the insert 2 by means of interlocking (latching-in) 19. The disc 5*a* has at least one ejection opening 6, the configuration and radial position of which corresponds to the lower outlet of a gap 8 between two cams 7*a* of the first cam ring 7. If during rotation, this ejection opening 6 comes to lie below a gap 8 between two cams 7*a*, then the corresponding pocket 9 is opened and its content is ejected, insofar as the dispenser is in its position of use with the cover 5 below. Whenever cup 1 and cover 5 are twisted in relation to one another by an additional partial step of the cam ring 7, then the next pocket 9 is open and releases its content, and so forth. On the cam ring 7 which is mounted rotatably on the insert, stop levers 15 have been disposed which engage each time with a notch 16 of the insert 2, whenever the ejection opening 6 releases (uncovers) a pocket 9.

Thus the dispenser is operated by turning it from stop to stop. A locking lever 17 disposed on the insert 2 in cooperation with a toothing 12 blocks any turning in the wrong rotational direction (FIG. 10).

For the purpose of controlling the supply of tablets, the cup part 1 can be made from transparent material. By means of ribs 18 running axially on the part of the cup which can be grasped by hand, the latter has been made more grippy for turning.

A fourth embodiment of the dispenser will be described on the basis of the FIGS. 11 to 15.

This embodiment is characterized by a mechanical conversion of movement. The operation in this case is accomplished manually and consists in the axial shifting of one construction unit in relation to another, just as say in case of a ball point pen where the lead projecting on top from the casing is pushed in with the thumb into the casing encircled by the hand.

Apart from the construction units 13, 21, 22, 27 for this conversion of movement the basic construction of the dispenser is in accordance with the generally described principle. The cup-shaped rotational body 1, briefly called the cup, in this case has a separate bottom based on reasons of manufacture, assembly and loading.

The annular cover 5 with the ejection opening 6 is firmly attached to the insert 2 and thus the cams 7*a* of the first cam ring 7 are rooted in the cup 1 while the superposed driver cams 10 are rooted in the insert 2. In this example, the part of the insert 2 projecting into the cup 1 has a partially cylindrical and partially cone-shaped outside surface.

In order to replace the rotational movement that has to be accomplished with two hands by an axial push movement which can be produced with one hand, the cup 1 and the insert 2 are surrounded by a casing 13 which projects by some length from the basic part of the dispenser consisting of cup 1 and insert 2 at the lower end, while the cup projects on top by at least so much from the casing as it comes up short on the bottom.

At the lower end of the casing 13, radially running bridges 20 carry a central element 21 which is intended to carry out manifold functions. First of all it is a support for a compression spring 22, which in rest position of the dispenser forces the original part 1, 2 with stops 23 of cup 1 against upper stops 24 of the casing 13.

Secondly, the central element 21 has a guide bushing 25 for spring guiding core 26 growing out of the insert 2 monolithically at the central position in the hollow space of the insert 2.

Thirdly, the central element 21 carries the elements 27, 28 on the side of the casing for the conversion of the axial movement between the basic parts 1, 2 and casing 13 of the dispenser into a relative rotation of the insert 2 in relation to the cup 1. These elements are tongues 27 connected monolithically with the central element 21, which are developed as sectors of a hollow cylinder 28 from which they grow out. The inside surfaces of these tongues 27 lie in the alignment of the inside surfaces of the hollow cylinder 28, while the outside surfaces run on the roots 29 with the outside surface 30 of the hollow cylinder 28 toward the upper end of the tongue but increasingly tapered. The tongues 27 — viewed in the rotational direction — are sloping away from front to back like teeth of a milling cutter. They are standing tangentially to the jacket of the hollow cylinder 28 with their bend-resistant edge-profile and they are resilient in radial direction.

The counter-piece to these spring tongues 27 forms the topography of the limitation of the hollow space in the inside of the part of the insert 2 projecting into the cup 1. The inside surface of the insert 2 has a number of spiral guide ramps 32 at the lower edge of each of which is a shoulder 31. The spiral guide ramps 32 run in the manner of a multi-pitched screw with a diameter decreasing in an upward direction. The shoulders 31 have been profiled in such a way that the insert 2 can be produced by way of injection moulding techniques with a simple axially opening mould without undercut. The guide ramps 32 lying between these shoulders 31 act as forcing guides for the spring tongues 27, whenever the basic parts 1, 2 of the dispenser are forced against the pressure of the spring 22 into the casing 13 from above to below. As a result of the cooperation of these spring tongues 27 and ramps 32, the insert 2 twists in the cup 1, while the spring tongues 27 are bending in relation to the axis of the system.

The axial shift between basic parts 1, 2 and casing 13 is limited downwards by lower stops 35 disposed in the inside of the casing 13, against which corresponding stops 23 rooted on the cup 1 abut, which also determine the rest position of the dispenser parts shiftable axially against each other owing to the force of the compression spring 22 and in cooperation with the upper stops 24 of the inside of the casing. With the limitation of the axial movement, the step of rotation which is carried out by the insert 2 in the cup 1, is also determined. The lift and the pitch of the spiral guide ramps 32 and the associated shoulders 31 in the inside of the insert is dimensioned in such a way that with every full lift from stop to stop the insert 2 completes a rotational step, which agrees with the partial step of the first cam ring 7 forming the pockets 9. If therefore, the ejection opening 6 in the cover 5 in the rest position has released the content of one pocket, then at the end of the first lift, it will open the next following pocket and so forth. The fashioning of the tongues 27 and of the guide guide ramps 32 in such, that the backward lift caused by the spring no longer exerts any influence on the relative position of cup 1 and insert 2. These two parts 1, 2 remain standing in relation to one another in the position which they reached at the end of the lift. At the end of the back lift, the tongues 27 are in such a position, that in the case of the next lift they will run in the next guide ramp 32 and against the bottom of the next shoulder 31. Since the rotating insert 2 is not accessible to the hand and therefore this phase of procedure cannot be interfered with, snap-in device between cup 1 and insert 2 can be omitted.

The axial gliding of the basic parts 1, 2 in the casing 13 is guided by grooves 33 and cams 34, which at the same time protect the cup 1 and the casing 13 from a relative twisting, that is to say in the case of the rotation of the insert 2, they will hold the cup 1 firmly. When mounting the individual parts of the dispenser, the cams 34 are snapped into the grooves 33. The cup 1 is then held by the stops 23, thus preventing separation of the cup from the casing 13. The insert 2 is pressed against the cam ring 7 of the cup by the biasing force of the spring 22. The cup 1 must be open at both ends for manufacturing purposes. After mounting and filling with particles, the cap 36 is pressed into the upper opening.

For the purpose of control of supply of particles, cup 1 and casing 13 can be made from transparent material, for example from plastic.

What is claimed is:

1. A dispenser for the individual release of particles predosed as bulk material and of a uniform shape and size, said dispenser comprising:

a. a first body having an open end and a closed end;

b. a second body disposed coaxially in said first body, extending from the open end thereof towards the closed end, and sized to leave an annular gap between said first and second bodies at least at the open end of said first body;

c. first means interconnecting said first and second bodies for permitting relative rotational motion and for preventing relative axial motion;

d. a casing disposed coaxially around said first body and extending from the open end thereof towards the closed end;

e. second means interconnecting said first body and said casing for permitting limited relative axial movement and for preventing relative rotational movement;

f. a central element disposed coaxially within said second body;

g. third means interconnecting said central element and said casing so that said central element moves axially with said casing;

h. fourth means carried by said central element for biasing said second body axially away from said central element, whereby said first body is moved to one extreme of its limited axial movement relative to said casing;

i. fifth means interconnecting said central element and said second body for converting axial movement of said central element into rotational movement of said second body, whereby relative axial movement of said first body and said casing causes relative rotational movement of said first body and said second body;

j. a cover closing the annular gap between said rotational bodies at the open end of said first rotational body, said cover having therein at least one ejection opening; and k. sixth means for organizing the bulk material within the dispenser so that, with repeated operation of the dispenser, the mass of the unorganized particles move in the direction of the open end of said first rotational body and, as they approach said cover, are organized in their spatial positions so that one particle at a time is fed to said at least one ejection opening and is thus prepared for a simple mechanical ejection, said means employing only gravity and the external forces which are applied for the operation of the dispenser.

2. A dispenser as recited in claim 1 and especially adapted for the individual release of particles each of which has one dimension less than the other two, said dispenser characterized in that:

a. said second body is partially cone-shaped;

b. said first and second bodies enclose a rotationally-symmetric inside space the cross-sections of which (viewed moving from the top of said first body towards said cover) vary from a fully circular form to an annular form, whereby the inner and outer boundaries of the inside space approach each other progressively until the inside space is narrowed down to the previously mentioned annular gap, which is sized to receive the particles only with their smallest dimensions within the width of the gap;

c. said cover is integral with one of said bodies; and d. the length of the arc of said at least one ejection opening is dimensioned in such a way that the particles can just drop through with their largest dimension.

3. A dispenser as recited in claim 2 wherein said sixth means comprises:

a. a first cam ring which
   i. projects into the annular gap,
   ii. is integral with the other one of said bodies,
   iii. has gaps therein sized to accept the longest dimension of the particles,
   iv. is disposed close above said cover, and
   v. is twistable in relation to said cover and b. a second cam ring which
   i. projects into the annular gap,
   ii. is integral with the first one of said bodies,
   iii. is disposed above and axially spaced from said first cam ring in register with said at least one ejection opening in said cover,
   iv. is not twistable in relation to said cover, and
   v. is sized to substantially cover up the gaps in said first cam ring when disposed over those gaps.

4. A dispenser as recited in claim 3 wherein the top of each segment of said first cam ring is sloped circumferentially with its lower end leading during relative rotation of said bodies, whereby said first cam ring transmits a perpendicular lifting movement to the particles which has an organizing and unjamming effect on them.

* * * * *